US005364075A

United States Patent [19]

Montgomery

[11] Patent Number: 5,364,075

[45] Date of Patent: Nov. 15, 1994

[54] RETRACTABLE MOUNT FOR A MOORING LINE GUIDE AND PROCESS FOR OPERATING THE SAME

[75] Inventor: James L. Montgomery, Seattle, Wash.

[73] Assignee: Smith Berger Marine, Inc., Seattle, Wash.

[21] Appl. No.: 940,105

[22] Filed: Sep. 3, 1992

[51] Int. Cl.[5] ..... B66D 3/04; B65H 23/32; B63B 21/00

[52] U.S. Cl. ..... 254/415; 254/413; 114/230; 226/197

[58] Field of Search ..... 254/413, 415, 410, 409, 254/389; 114/230; 242/157 R; 226/195, 197, 196, 199

[56] References Cited

U.S. PATENT DOCUMENTS

| | | | |
|---|---|---|---|
| 699,144 | 5/1902 | Burt | 254/413 X |
| 2,347,885 | 5/1944 | Crickmer | 254/389 |
| 2,990,803 | 7/1961 | Henderson | 114/230 |
| 3,035,535 | 5/1962 | Billups | 114/230 X |
| 3,166,038 | 1/1965 | Brittain et al. | 114/230 |
| 3,952,684 | 4/1976 | Ferguson et al. | 114/230 |
| 4,020,779 | 5/1977 | Kitt | 114/230 X |
| 4,305,341 | 12/1981 | Stafford | 114/230 |
| 4,497,471 | 2/1985 | Longberg et al. | 114/230 X |
| 4,742,993 | 5/1988 | Montgomery et al. | 254/389 |
| 5,041,038 | 8/1991 | Poldervaart et al. | 114/230 X |

FOREIGN PATENT DOCUMENTS

| | | | |
|---|---|---|---|
| 2094738 | 9/1982 | United Kingdom | 114/230 |

*Primary Examiner*—Daniel P. Stodola
*Assistant Examiner*—Michael R. Mansen
*Attorney, Agent, or Firm*—Robert W. Beach

[57] ABSTRACT

As a carriage carrying a mooring line guide is lowered by paying out a hoisting line two retaining projections mounted on the carriage are inserted into complementary stationary sockets to anchor the carriage in a lower position, As the carriage reaches such lower position two reciprocable latch pins mounted on the carriage are projected by compression springs into stationary sockets to lock the retaining projections in their sockets, Retraction of such latch pins in opposition to the force of such compression springs to remove the latch pins from their sockets is effected by tensioning of the hoisting line, The carriage is guided for elevational movement by rollers engageable with upright tracks or by guide sleeves encircling an upright taut guide line.

12 Claims, 6 Drawing Sheets

10
8
2
8
11
12
12
18
20
3
18
9
1
5
10
16
4
10
2

8
10
8
9
11
21
12
21
23
9
9
20
14
20
22
22
18
13
18
7
7
5
16
15

5
8
1
9
4
15
16

9
8
7
6
5
6
7
8
19
19
12
23
12
18
18
21
20
20
22
22
2
3
1

RETRACTABLE MOUNT FOR A MOORING LINE GUIDE AND PROCESS FOR OPERATING THE SAME

BACKGROUND OF THE INVENTION

1. Field of the Invention

This invention relates to fairleads or line guides for vessels and more particularly to such a mooring line fairlead which is mounted on a carriage that can be lowered to a submerged operative position and retained in such position automatically in response to lowering of the carriage to such operative position.

2. Prior Art

A mooring line fairlead which can be mounted on the retractable mount of the present invention is shown in Montgomery et al. U.S. Pat. No. 4,742,993, issued May 10, 1988, but the retractable mount of the present invention can also be use to mount other types of mooring line guides. The mooring line fairlead of U.S. Pat. No. 4,742,993 can swivel about an upright axis as the vessel shifts so that the mooring line will remain aligned with the plane of the arcuate guide.

THE PROBLEM

A problem with the mooring line fairlead arrangement shown in U.S. Pat. No. 4,742,993 and similar mooring line guide arrangements is that the mounting for the fair lead is secured to the vessel in a manner such as shown in FIG. 1 of that patent to dispose the fairlead in a position submerged beneath the surface of water. In order to repair or service the mounting line fairlead, it was necessary either for such repair or servicing operation to be accomplished by a diver working beneath the surface of the water, or it was necessary for a diver working beneath the surface of the water to detach the mooring line fairlead from its supporting mechanism such as removing the bolts 45 shown in FIG. 9 of that patent. Instead of working beneath the surface of the water at all, it was preferable for the vessel to be removed from its mooring and put in drydock for maintenance, which was a very expensive procedure.

SUMMARY OF THE INVENTION

The principal object of the present invention is to provide an elevationally movable mount for a mooring line guide or fairlead which can be moved between an operative position submerged beneath the surface of water and a position above the surface water without requiring services of a diver.

In connection with this principal object, it is an object to retain the mooring line fairlead positively in its submerged operative position automatically in response to lowering of the fairlead into its operative position.

A further object is to be able to release latch mechanism for the mooring line fairlead in its submerged operative position automatically in response to initiating the hoisting operation of the fairlead.

Another object is to provide retaining mechanism for the mooring line fairlead mount in its submerged operative position which is rugged and strong so that it can transmit large forces between the fairlead and the vessel.

The foregoing objects can be accomplished by providing a retractable mount for a mooring line guide or fairlead which is mounted on a carriage guided for elevational movement relative to a vessel and which carriage has projection and socket latch means interengageable between it and the vessel automatically in response to elevational movement of the carriage relative to the vessel and/or movement relative to the carriage of hoisting line means for the mount.

DETAILED DESCRIPTION

Figure 1:
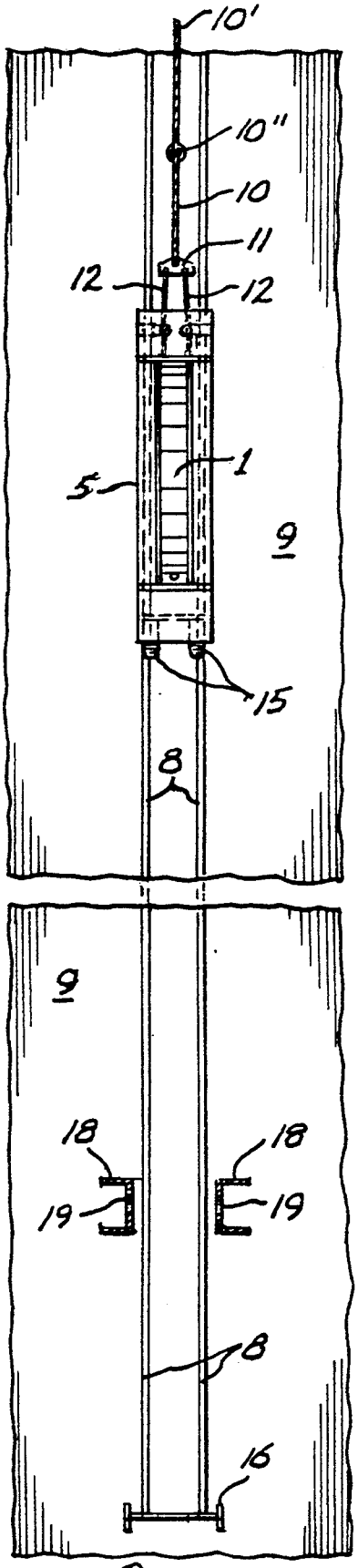
FIG. 1 is an elevation of the mooring line fairlead mount applied to a vessel showing the mount in raised position.

The general environment in which fairleads or line guides are used in the mooring of a vessel is illustrated in FIG. 1 of U.S. Pat. No. 4,742,993. In that embodiment, the fairleads or line guides are mounted in elevationally fixed operative positions submerged beneath the surface of water. The present invention provides an elevationally movable mount for the line guide enabling such line guide to be moved from an operative position submerged beneath the surface of water to an elevated position above the surface of the water to provide access to the line guide removed from its submerged operative position for repair or servicing.

Figure 3:
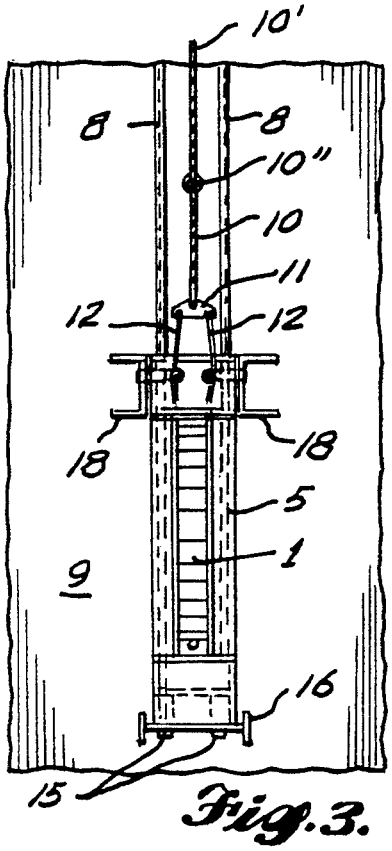
FIG. 3 is an elevation similar to the lower portion of FIG. 1 but showing the mount in its submerged operative position.
Figure 4:
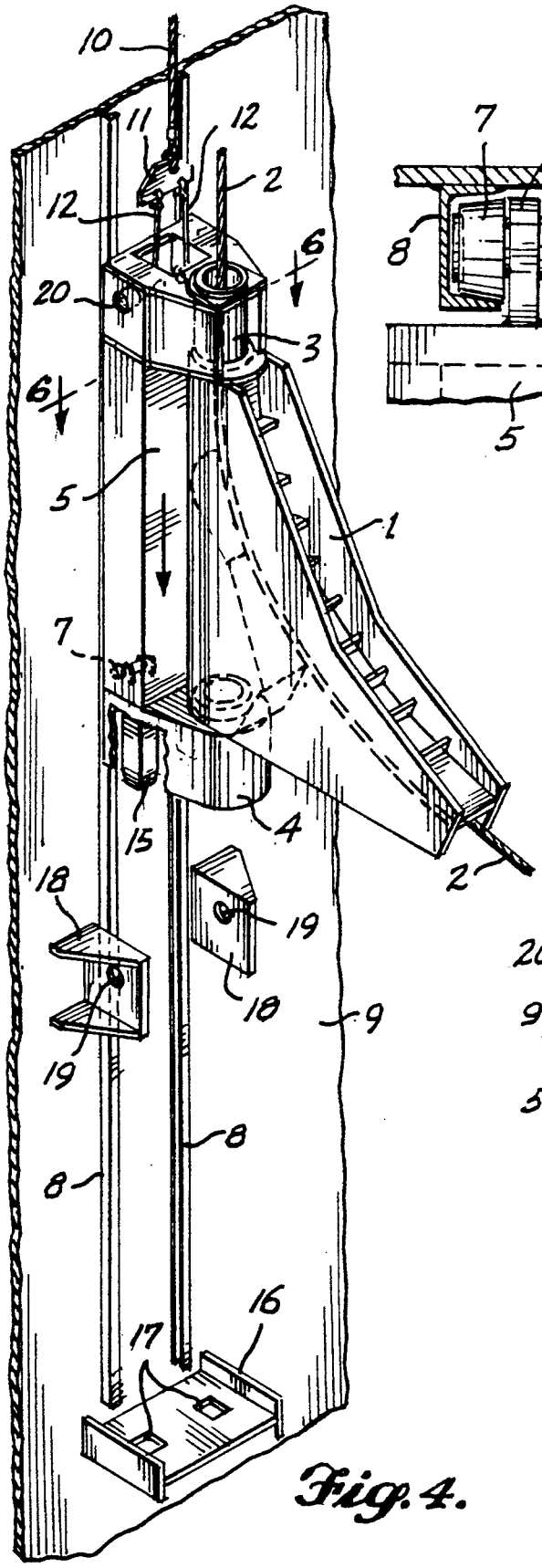
FIG. 4 is an enlarged top perspective of the mount showing the fairlead somewhat raised from its submerged operative position.
Figure 7:
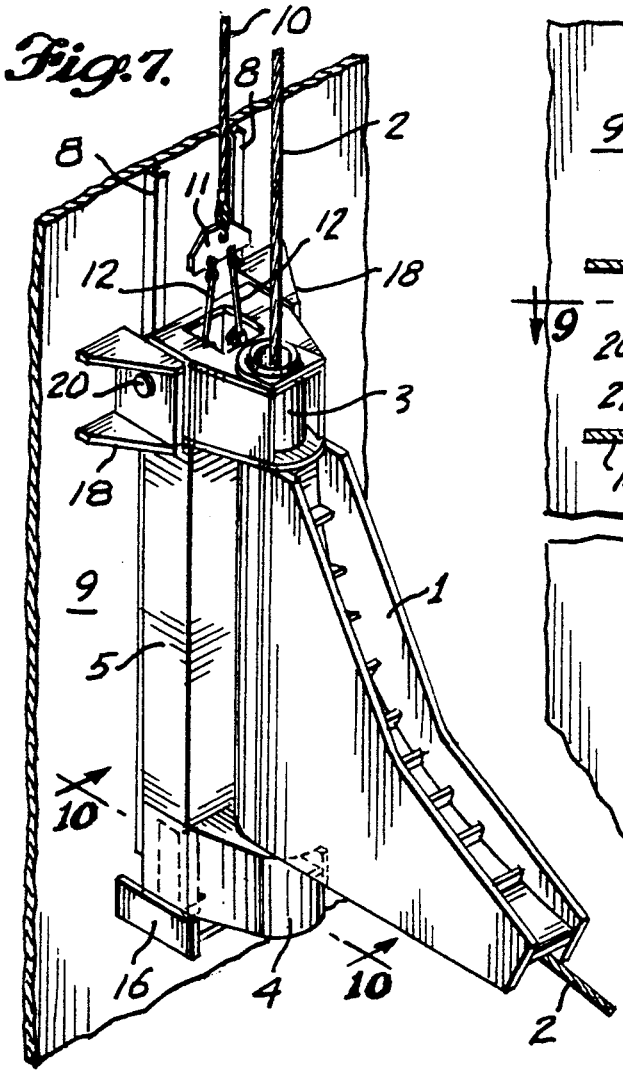
FIG. 7 is a top perspective of the mount similar to FIG. 4 but showing the mount in its submerged operative position.

In FIGS. 1 and 4 the fairlead 1 is shown in position raised above the surface of water, and in FIGS. 3 and 7 the fairlead is shown in its submerged operative position. A mooring line 2 is shown in FIGS. 4 and 7 as extending through the fairlead. When the fairlead is in its submerged operative position of FIG. 7, the mooring line 2 would be under tension whereas, when the mooring line fairlead is raised into the position of FIG. 4, the mooring line would be slack. The arcuate fairlead 1 is mounted by an upper trunnion 3 and a lower trunnion 4 for swinging to maintain the upright plane of the line guide in registration with the portion of the mooring line extending downward beyond the fairlead when the fairlead is in its submerged operative position of FIG. 7.

Figure 6:
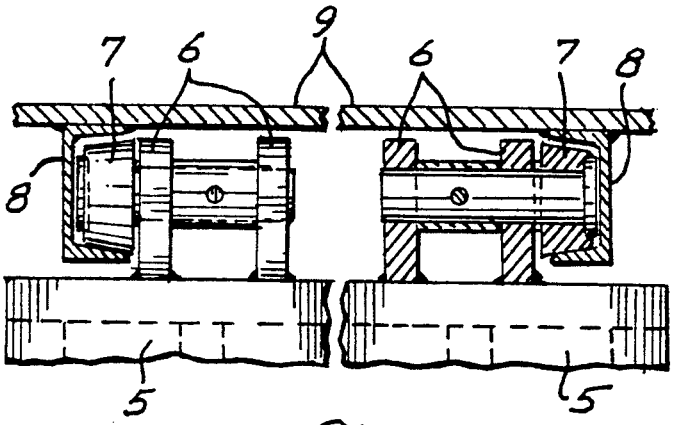
FIG. 6 is a transverse horizontal section through a portion of the mount taken on line 6—6 of FIG. 4 showing guide mechanism.

The trunnions 3 and 4 for supporting the fairlead 1 are mounted on a mount 5 which in the present invention is elevationally movable and constitutes a carriage. The carriage is guided for linear elevational movement by brackets 6 attached to the back of the carriage for mounting tapered guide rollers 7 received in flared channel-shaped tracks 8 as shown best in FIG. 6. Such tracks are welded to a side of the vessel 9 in vertical position as shown in FIGS. 1, 3, 4 and 7. Preferably a pair of such guide rollers is mounted on the upper portion of the carriage 5 and a similar pair of such guide rollers is mounted near the lower end of such carriage. Such guide rollers will guide the carriage for movement between a retracted position elevated above the surface of water as shown in FIGS. 1 and 4 and a submerged operative position of the line guide shown in FIGS. 3 and 7.

The carriage is supported and moved by a hoisting line 10 by which the weight of the carriage can be supported as it is lowered from its upper retracted position shown in FIGS. 1 and 4 to its submerged operative position shown in FIGS. 3 and 7, and such hoisting line can be reeled in to raise the carriage again from such operative position to its upper retracted position.

Figure 2:
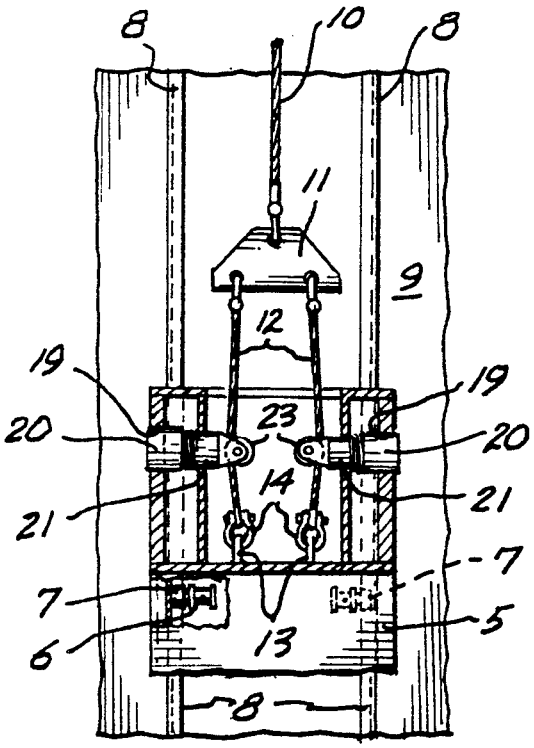
FIG. 2 is an enlarged fragmentary elevation of a portion of the mooring line fairlead mount with parts broken away.
Figure 8:
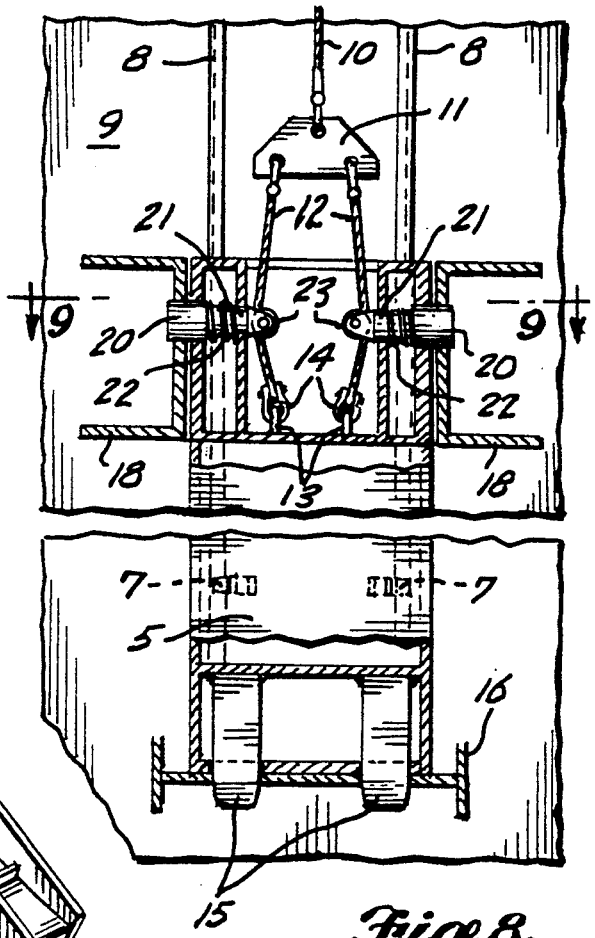
FIG. 8 is a fragmentary front elevation of a portion of the mount with parts broken away.

The hoisting line 10 is not attached directly to the carriage 5 but, as shown best in FIGS. 2 and 8, the lower end of the hoisting line is connected to the central portion of an equalizer yoke 11. Short auxiliary hoisting lines 12 connect the opposite end portions of such yoke, respectively, to eyes 13 on the carriage by shackles 14.

Figure 10:
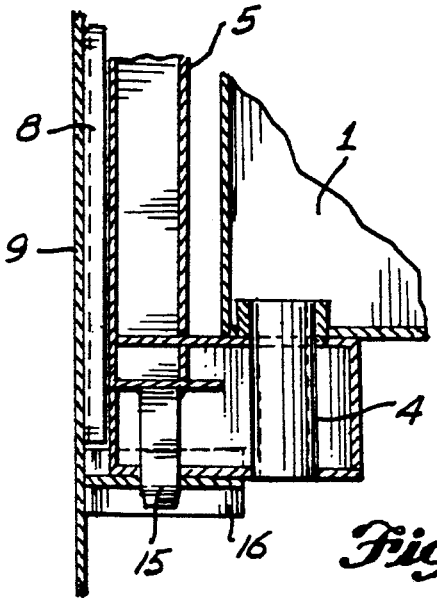
FIG. 10 is a fragmentary vertical section through a portion of the mount taken on line 10—10 of FIG. 7.

Latching projections 15 are fixedly mounted on the lower end of the carriage 5 projecting downward below its bottom as shown best in FIGS. 1 and 8. Preferably such projections are spaced transversely of the direction of elevational movement of the carriage 5. A socket member bar 16 of H-beam cross section is fixed, such as being welded, to the wall 9 of the vessel as shown in FIG. 4. Such socket member bar has in its web socket apertures 17 spaced away from the wall of the vessel and also spaced parallel to he vessel wall transversely of the elevational movement of the carriage 5 a distance corresponding to the lateral spacing of the projections 15 which extend downward from the bottom of the carriage. Consequently, when the carriage is lowered to its submerged operative position shown in FIGS. 3, 7 and 8, the latching projections 15 will be inserted automatically into their respective socket apertures 17 of the socket bar 16 as shown in FIGS. 3, 8 and 10.

While the engagement of latching projections 15 in the socket apertures 17 when the carriage 5 is in its submerged operative position as described above will restrain movement of the carriage both away from and parallel to the vessel wall 9 in addition to the restraint afforded by engagement of the guide rollers 7 in the tracks 8, such latch mechanism will not prevent upward movement of the carriage 5 from its submerged operative position. Consequently, it is desirable to provide latch mechanism between the carriage 5 and the vessel 9 in addition to the guide rollers 7 engaged in tracks 8 and the projections 15 engaged with socket bar 16.

As shown in FIGS. 2 and 8, the eyes attached to the carriage 5, to which the auxiliary hoisting lines 12 are connected, are located in the bottom of a cavity in the upper portion of the carriage. Latch socket brackets 18 are attached to the vessel wall 9 at locations on opposite sides of the path of elevational travel of the carriage 5. Such socket brackets are of channel shape, as shown in FIGS. 1, 3 and 4, and have in their webs socket apertures 19 located in a position such that, when the carriage 5 is bottomed in its submerged operative position shown in FIGS. 3, 7 and 8, such apertures will be located in registration, respectively, with the heads 20 of latch pins mounted in apertures in carriage 5 for reciprocation transversely of the direction of elevational movement of the carriage between the latched position shown in FIGS. 3, 8 and 9 and the unlatched position shown in FIGS. 1 and 2. The heads 20 of the latch pins form projections that, by lengthwise reciprocation of the pins, can be extended from the retracted position of FIG. 2 into the latched positions of FIGS. 8 and 9 in which the pin heads project into and preferably through the apertures 19 in the socket brackets 18.

Figure 9:
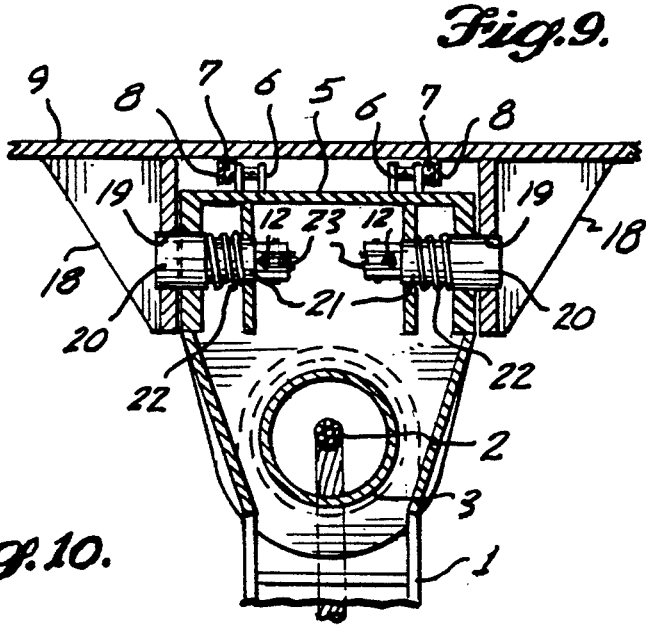
FIG. 9 is an enlarged transverse horizontal section through a portion of the mount taken on line 9—9 of FIG. 8.

The latch pins are guided for reciprocation of their heads 20 into and for withdrawal from the latch apertures 19 by having shanks 21 of somewhat reduced size as compared to their heads, and such shanks and heads are guided for reciprocation in apertures of the carriage 5 as shown in FIGS. 8 and 9. The latch pins are urged toward their projected positions of FIGS. 8 and 9 from their retracted positions of FIG. 2 by helical compression springs 22 encircling the pin shanks 21 and reacting between the shoulder formed by the junction of the pin shanks and heads and an apertured guide member of the carriage 5.

A pulley 23 is mounted on the inner end of each latch pin shank 21, and the auxiliary hoisting lines 12 pass around those pulleys between the equalizer yoke 11 and the anchoring eyes 13, as shown in FIGS. 2 and 8. Tensioning of the auxiliary hoisting lines 12 by pulling on hoisting line 10 will tend to straighten such auxiliary hoisting lines toward parallelism. Such tension in the auxiliary hoisting lines will produce a force transversely of such lines acting on the pulleys 23 in opposition to the force exerted by compression springs 22 which will slide the latch pins toward each other from the latching positions shown in FIG. 8 to the released positions shown in FIG. 2. Such movement will retract the latch pins so that their outer ends do not project appreciably beyond the sides of the carriage 5.

Figure 11:
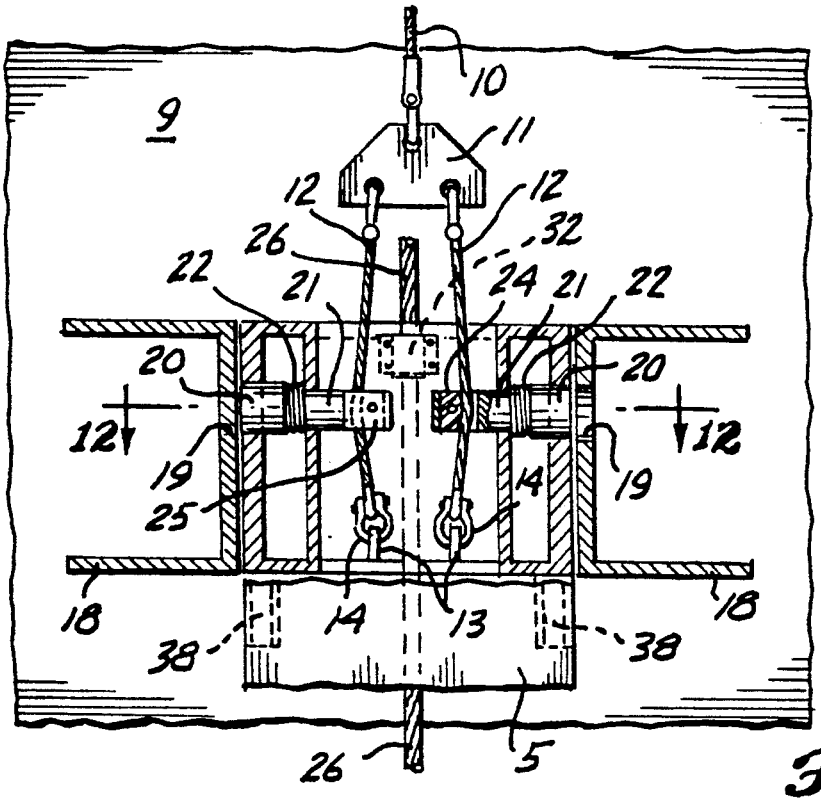
FIG. 11 is a fragmentary front elevation of a portion of the mount with parts broken away similar to FIG. 8 but showing a modified type of structure.
Figure 12:
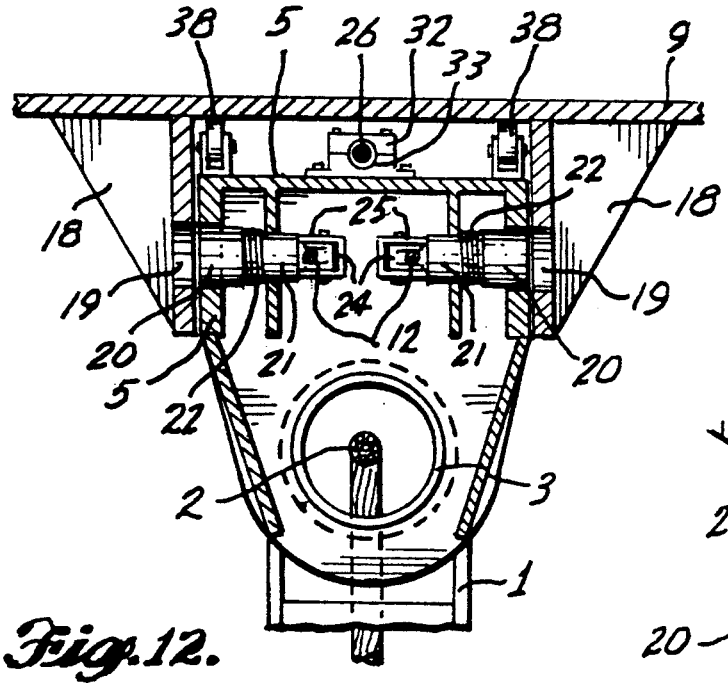
FIG. 12 is an enlarged transverse horizontal section through a portion of the mount taken on line 12—12 of FIG. 11.
Figure 13:
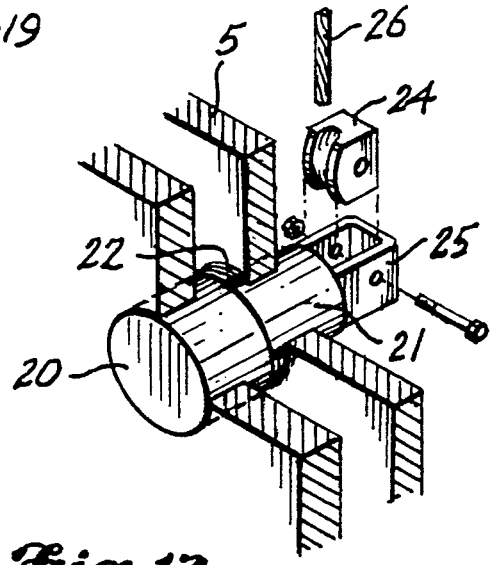
FIG. 13 is a further enlarged detail top perspective of a portion of the mount shown in FIGS. 11 and 12 with parts shown in exploded relationship.

FIGS. 11, 12 and 13 show a modification of the latch-actuating mechanism. Instead of the auxiliary hoisting lines 12 engaging pulleys carried by the shanks 21 of the latching pins, guide blocks 24 made of plastic are mounted in sockets 25 on the ends of the pin shanks as shown in FIGS. 11, 12, and 13. The blocks can be suitably held in their sockets by a bolt or rivet, as indicated in FIG. 13. The auxiliary hoisting lines 12 will have sliding contact with such blocks, but there will be only a small relative movement between the blocks and lines as the pull on lines 12 slides the latch pins from the latched position of FIGS. 8 and 9 to the unlatched position of FIGS. 11 and 12.

Figures 14, 15:
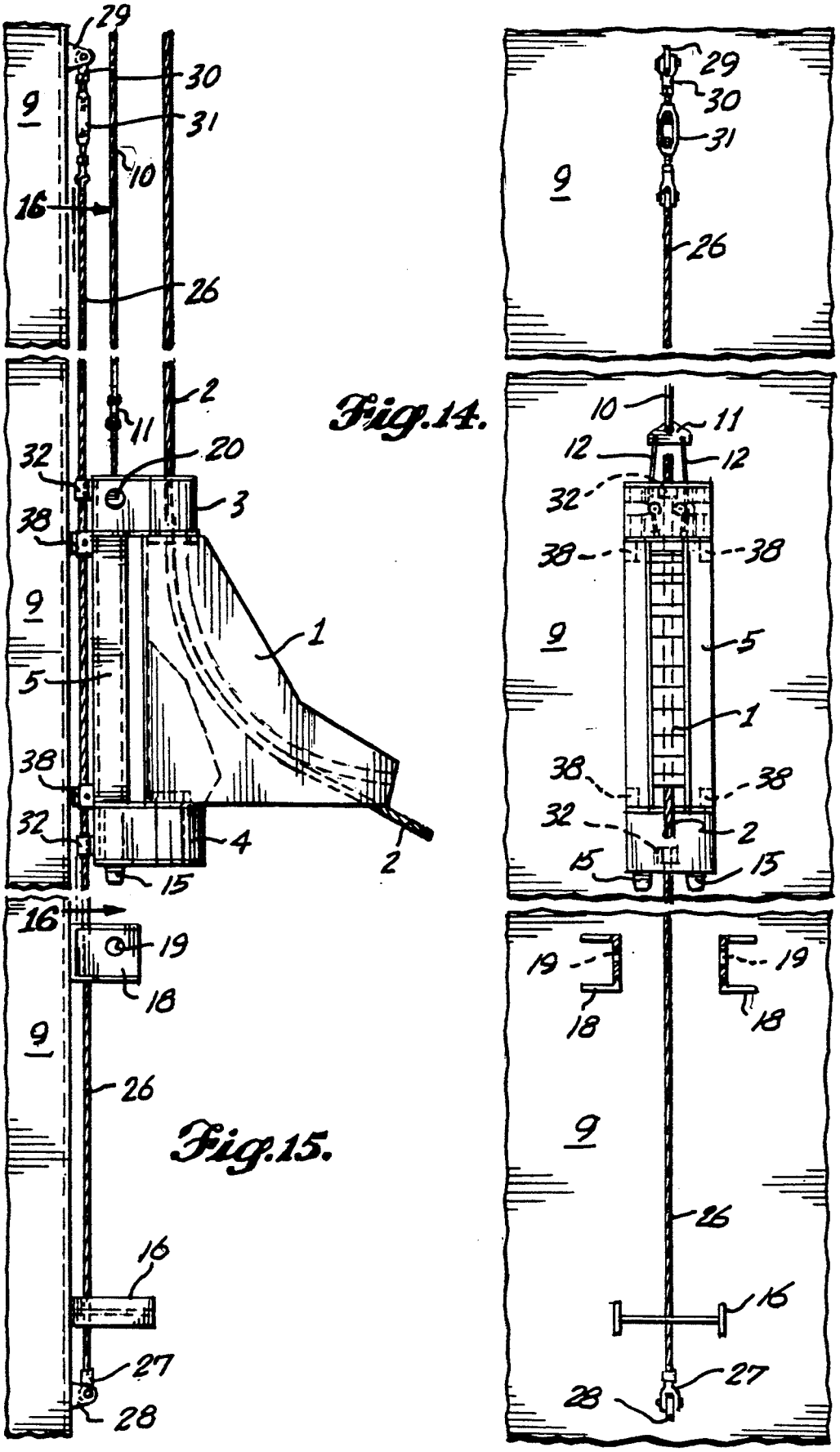
FIG. 14 is a front elevation of the mooring line guide mount applied to a vessel showing the mount in raised position, which view is similar to FIG. 1, but FIG. 14 shows another embodiment of the mount.
FIG. 15 is a side elevation of the embodiment of the mount shown in FIG. 14.

In the embodiment of the mount shown in FIGS. 14 to 17, the guide mechanism including rollers and tracks described in connection with FIGS. 1 to 6 has been modified by replacing such rollers and tracks with a taut line mechanism for guiding elevational movement of the carriage 5. In this embodiment, the vertical taut line 26 is strung in a position parallel to the wall 9 of the vessel's hull as shown in FIG. 15. A clevis fitting 27 on the lower end of the line is attached to an apertured bracket 28 secured to the wall of the vessel 9 at a location below the latch bar 16, as shown in FIGS. 14 and 15.

The upper end of the guide line 26 is secured to an apertured bracket 29 located above the desired uppermost position of the carriage 5 by a clevis fitting 30 of a turnbuckle 31 that is suitably attached to the upper end of the guide line 26. By rotation of the turnbuckle coupling, guide line 26 can be stretched into taut condition between the brackets 28 and 29.

The carriage 5 is guided by the taut guide line 26 for linear elevational travel by running such guide line through guide sleeves 32 mounted on the back of the carriage 5, one near the top and one near the bottom of the carriage.

Figure 17:
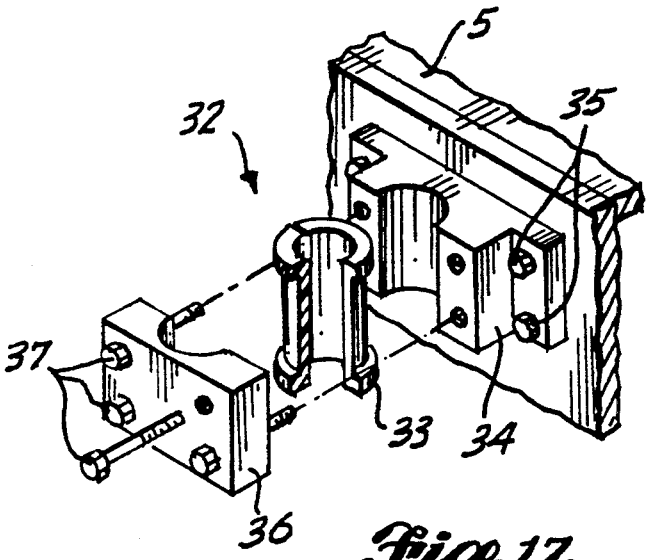
FIG. 17 is an enlarged detail top perspective of a portion of the mount with parts broken away and parts shown in exploded relationship.

The preferred construction of a guide sleeve is shown in FIG. 17 as including a split bushing 33 of antifriction plastic material such as nylon. The bushing is split lengthwise into two halves so that the parts of the bushing can be assembled around the line 26 instead of requiring the line to be threaded through the bushing.

The bushing is mounted in a clamp including the clamp base block 34 secured to the back of the carriage 5 by bolts 35. The bushing is then confined in the recess in the clamp base by a saddle cap 36 secured over the bushing by cap screws 37 screwed into tapped holes in the clamp base 34.

Figure 16:
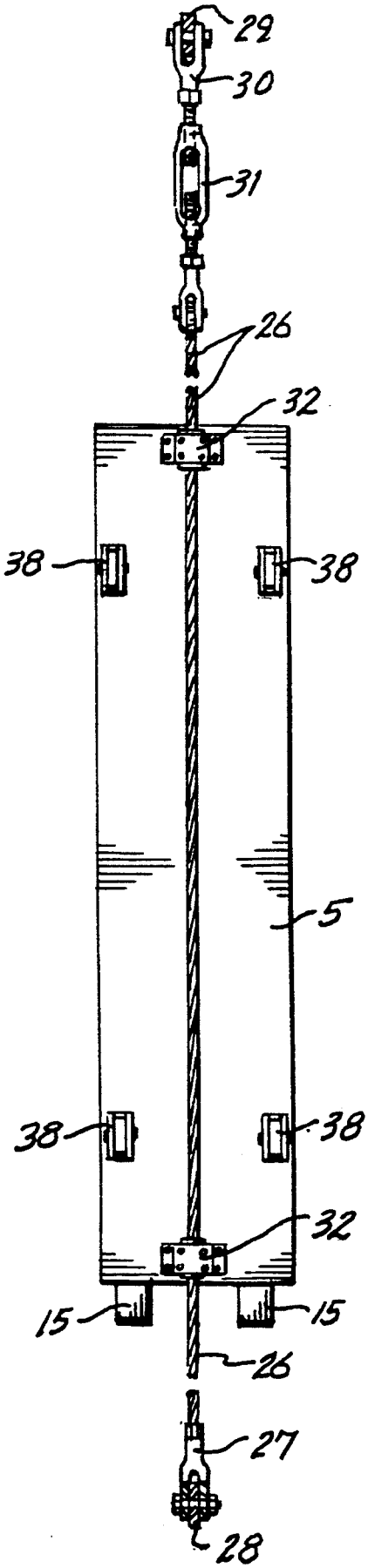
FIG. 16 is a rear elevation of the mount.

To limit rocking of the carriage 5 about the axis of the taut line 26, stabilizer rub blocks 38 are mounted on the opposite upright edges of the back of carriage 5 as shown in FIGS. 12 and 16. Such blocks will have slight clearance from the wall 9 of the vessel when the carriage is strung on the line 26 as shown in FIG. 12.

In operation, when the carriage 5 is supported by a pull on the hoisting line 10, the auxiliary hoisting lines 12 will be tensioned and held in the nearly straight position shown in FIGS. 2 and 11 so that the latch pins 20 are retracted to dispose their outer ends substantially flush with the opposite sides of the carriage 5. If the hoisting line 10 is paid out, the weight of the fairlead 1 and carriage 5 will move the carriage downward until its lower end bottoms on the stop and latch bar 16 as shown in FIGS. 8 and 10. Such bottoming of the carriage 5 will locate the fairlead 1 in its submerged operative position.

While the carriage 5 could be held against appreciable movement relative to the vessel 9 in such submerged operative position by engagement of the guide rollers 7 with the tracks 8 or the taut guide line 26 with the guide sleeves 32 and by the weight of the carriage and fairlead, it is preferred that the carriage be latched to the vessel 9 in the submerged position of the carriage to enable stresses to be transmitted from the mooring line 2 through the fairlead 1 to the vessel more directly. Consequently, when the carriage 5 has reached its submerged operative position, the bottom latching projections 15 on the carriage will have been inserted automatically into the apertures 17 of the stop and latch bar 16, as shown in FIGS. 7, 8 and 10.

While engagement of the latching projections 15 in the apertures 17 will assist in preventing movement of the carriage away from the vessel 9 and also parallel to the vessel wall, such latch arrangement will not prevent upward movement of the carriage relative to the vessel.

To prevent movement of the carriage 5 upward relative to the vessel from its submerged operative position shown in FIGS. 3 and 8, when the carriage is lowered to such position the heads 20 of the upper latch pins will be in registration with the apertures 19 of the latch brackets 18 shown in FIGS. 4 and 8. As the upward pull on hoisting line 10 is relaxed, the tension in the auxiliary hoisting lines 12 will be relieved to enable the compression springs 22 to project the latch pins from the retracted positions shown in FIGS. 2, 11 and 12 to the projected positions shown in FIGS. 8 and 9 in which heads 20 of the latch pins extend from the carriage 5 into or through the socket apertures 19 of the latch brackets 18.

Such engagement of the latch pins in the latch sockets will prevent upward movement of the carriage 5 relative to the vessel 9 and also movement away from the vessel until a sufficient pull is again exerted on the hoisting line 10 to tension the auxiliary hoisting lines 12 sufficiently so that their tendency to straighten will overcome the outward force of the compression springs 21 and retract the latch pins from their projected positions of FIGS. 8 and 9 to their retracted positions of FIGS. 2, 11 and 12. When the pin heads 20 are thus unlatched, the pull exerted on the hoisting line 10 will act through the auxiliary hoisting lines 12 to lift the carriage 5 and fairlead 1 upward along tracks 8 or guide line 26 to an elevated position such as shown in FIG. 1.

The carriage can be held in such elevated retracted position either by maintaining a pull on the hoisting line 10 or by retaining the carriage in such upper position in some other way. A segmented hoisting line may be used for greater depths.

Figure 5:
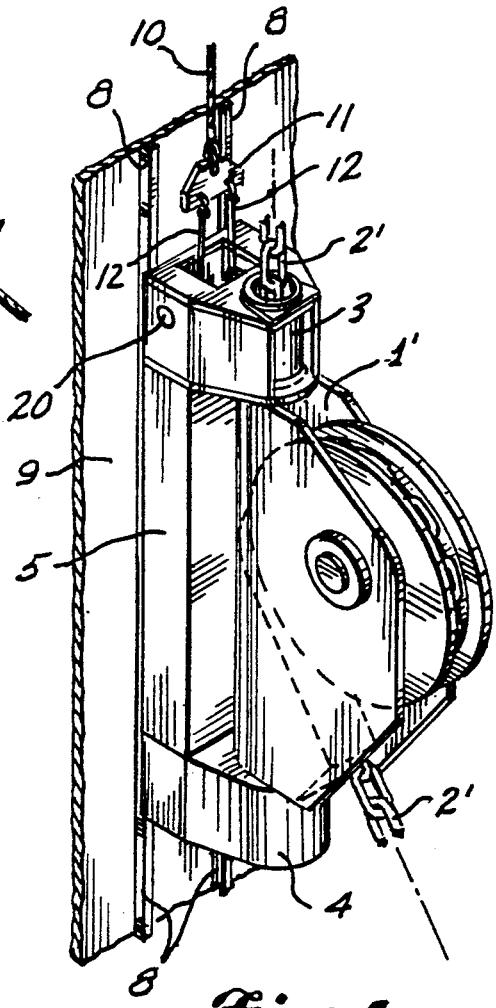
FIG. 5 is a top perspective similar to FIG. 4 showing a different type of mooring line guide.

While the structure and operation of the line guide mount has been discussed with respect to the fairlead 1 shown in FIGS. 4 and 7, the carriage 5 could be used as a mount for other types of line guides. FIG. 5, a sheave type of line guide 1' is shown which is used as a guide for a mooring line in the form of a chain 2'. The guide sheave is mounted for swiveling by trunnions 3 and 4 similar to the trunnions on which the fairlead 1 is shown as being mounted in FIGS. 4 and 7. The apparatus for mounting the carriage 5 shown in FIG. 5 is the same as that shown in FIGS. 1 to 4 and 6 to 10 or FIGS. 14 and 15.

I claim:

1. In a retractable mount for a mooring line guide for a mooring line for a vessel including a carriage carrying the mooring line guide and guide means mounted on the vessel guiding the carriage for elevational movement between a lower position in which the mooring line guide is submerged beneath the surface of water and a retracted position elevated above the surface of the water in which the mooring line guide can be serviced or in which the mooring line guide can be removed from the carriage for servicing, the improvement comprising retaining means separate from said guide means including socket means and projection means, said projection means being interengageable with said socket means only when the carriage is in its lower position, one of said socket means and projection means being elevationally fixed with respect to the vessel at a location adjacent to the lower position of the carriage and the other of said socket means and projection means being carried by the carriage.

2. The mount defined in claim 1, in which the socket means is elevationally fixed with respect to the vessel at a location adjacent to the lower position of the carriage, and the projection means is carried by the carriage.

3. The mount defined in claim 2, in which the projection means includes a pin guided for movement transversely of the direction of movement of the carriage along the guide means between a projected position in engagement with the socket means and a retracted position withdrawn from engagement with the socket means.

4. The mount defined in claim 3, in which the projection means includes two aligned latch pins movable oppositely transversely of the direction of movement of the carriage along the guide means, the socket means includes two sockets one for each of said latch pins, and actuating means for moving said latch pins simultaneously toward each other out of engagement with their respective sockets.

5. The mount defined in claim 4, including hoisting line means for raising the carriage along the guide means from its lower position, and the actuating means are operable to retract the latch pins from their sockets automatically in response to upward movement of the hoisting line means relative to the carriage.

6. The mount defined in claim 5, in which the hoisting line means includes an equalizer yoke and two generally parallel auxiliary hoisting lines connecting said equalizer yoke to the carriage and constituting the actuating means for the latch pins operatively connected to the latch pins to retract them toward each other from their respective sockets when a pull is exerted on the hoisting line tending to straighten said auxiliary hoisting lines.

7. The mount defined in claim 1, in which the projection means and the socket means are interengageable automatically by movement of the carriage into its lower position.

8. The mount defined in claim 1, in which the guide means includes a taut guide line mounted stationarily on the vessel and a guide sleeve carried by the carriage embracing said taut guide line and slidable therealong to guide elevational movement of the carriage along said taut line.

9. In a a retractable mount for a mooring line guide for a mooring line for a vessel mounted on an elevationally adjustable carriage, including means for lowering the carriage into a lower position submerged below the surface of water, the improvement comprising a retaining projection member and a socket member interengageable only in the lower position of the carriage, one of said members being mounted on the vessel at a location adjacent to the lower position of the carriage and the other of said members being mounted on the carriage.

10. The mount defined in claim 9, including hoisting line means attached to the carriage for raising it, and the projection member being retractable from the socket member automatically in response to tensioning of the hoisting line means.

11. The mount defined in claim 10, including means guiding the projection member for movement transversely of the hoisting line means out of the socket member.

12. In a retractable mount for a mooring line guide for a mooring line for a vessel including a carriage carrying the mooring line guide, the improvement comprising a taut guide line mounted on the vessel, and a guide sleeve carried by the carriage embracing said taut guide line and slidable therealong for guiding elevational movement of the carriage along said taut line between a lower position in which the mooring line guide is submerged beneath the surface of water and a retracted position elevated above the surface of the water in which the mooring line guide can be serviced or in which the mooring line guide can be removed rom the carriage for servicing.

* * * * *

UNITED STATES PATENT AND TRADEMARK OFFICE

CERTIFICATE OF CORRECTION

PATENT NO. : 5,364,075

DATED : November 15, 1994

INVENTOR(S) : James L. Montgomery

It is certified that error appears in the above-identified patent and that said Letters Patent is hereby corrected as shown below:

ON THE TITLE PAGE:
Section [57] ABSTRACT: lines 5, 8 and 12 of the ABSTRACT, cancel the comma and insert a period in each instance.

Claim 9: column 8, line 7, cancel "a" (second instance).

Claim 12: column 8, line 38, cancel "rom" and insert --from--.

Signed and Sealed this

Eighteenth Day of April, 1995

Bruce Lehman

*Attest:*

BRUCE LEHMAN

*Commissioner of Patents and Trademarks*

*Attesting Officer*